US005408173A

United States Patent [19]

Knapp

[11] Patent Number: 5,408,173

[45] Date of Patent: Apr. 18, 1995

[54] MANUAL-ADJUSTMENT-FREE CONTROLLED-VOLTAGE AND CURRENT-LIMITED D.C. VOLTAGE SUPPLY

[75] Inventor: Herbert C. Knapp, Holliston, Mass.

[73] Assignee: Kronos Incorporated, Waltham, Mass.

[21] Appl. No.: 955,043

[22] Filed: Oct. 1, 1992

[51] Int. Cl.[6] ..... G05F 1/575

[52] U.S. Cl. ..... 323/285; 323/282; 363/79

[58] Field of Search ..... 323/282, 285, 351; 363/74, 78, 79

[56] References Cited

U.S. PATENT DOCUMENTS

| | | | |
|---|---|---|---|
| 3,818,307 | 6/1974 | Hamilton et al. | 321/11 |
| 4,037,271 | 7/1977 | Keller | 363/21 |
| 4,287,515 | 9/1981 | Raber et al. | 340/584 |
| 4,292,581 | 9/1981 | Tan | 323/283 |
| 4,315,207 | 2/1982 | Apfel | 323/284 |
| 4,378,530 | 3/1983 | Garde | 330/297 |
| 4,494,064 | 1/1985 | Harkness | 323/277 |
| 4,616,302 | 10/1986 | Mandelcorn | 363/50 |
| 4,823,070 | 4/1989 | Nelson | 323/285 |
| 4,891,764 | 1/1990 | McIntosh | 364/508 |
| 4,920,309 | 4/1990 | Szepesi | 323/269 |
| 4,929,882 | 5/1990 | Szepesi | 323/222 |
| 4,959,797 | 9/1990 | McIntosh | 364/508 |
| 5,055,767 | 10/1991 | Nelson | 323/285 |
| 5,103,404 | 4/1992 | McIntosh | 318/568 |
| 5,124,617 | 6/1992 | Ball | 323/285 |
| 5,264,781 | 11/1993 | Miller et al. | 323/282 |
| 5,289,046 | 2/1994 | Gregorich et al. | 307/66 |
| 5,302,889 | 4/1994 | Marsh | 323/284 |

*Primary Examiner*—Steven L. Stephan
*Assistant Examiner*—Adolf Berhane
*Attorney, Agent, or Firm*—Weingarten, Schurgin, Gagnebin & Hayes

[57] ABSTRACT

Voltage-control and current-limiting negative feedback loops are disclosed that cooperate with an adjustable voltage regulator to provide a constant-amplitude and current-limited D.C. voltage. The regulator and voltage-controlling and current-limiting feedback loops are constituted by low-cost circuit elements that cooperate to provide high-precision voltage and current regulation in a manner that is free from manual adjustment. The circuit of the invention is particularly adapted to charging lead-acid batteries.

20 Claims, 1 Drawing Sheet

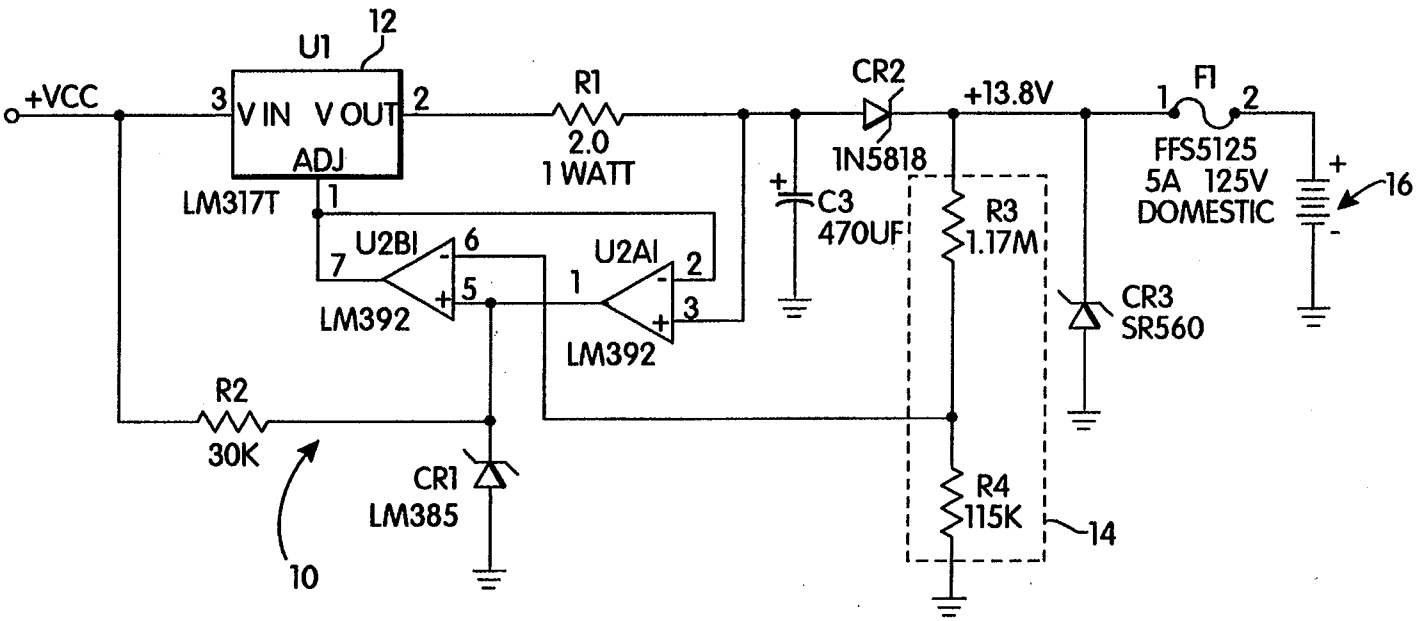
16
+
-
F1
1
2
FFS5125
5A 125V
DOMESTIC
CR3
SR560
14
+13.8V
R3
1.17M
R4
115K
CR2
1N5818
C3
470UF
R1
2.0
1 WATT
U2A
LM392
U2B
LM392
CR1
LM385
12
U1
V IN
V OUT
ADJ
LM317T
R2
30K
10
+VCC

MANUAL-ADJUSTMENT-FREE CONTROLLED-VOLTAGE AND CURRENT-LIMITED D.C. VOLTAGE SUPPLY

FIELD OF THE INVENTION

This invention relates to the field of amplifiers, and more particularly, to a novel manual-adjustment-free controlled-voltage and current-limited D.C. voltage supply.

BACKGROUND OF THE INVENTION

Many commercial products use a lead-acid or other battery for backup operation applications. These products require circuits to recharge their backup batteries. The heretofore known constant-voltage lead-acid battery chargers include circuits based on adjustable linear regulators, and circuits based around single-chip charger I.C.'s. Those configured around adjustable linear regulators had few components but required manual adjustment of a potentiometer to set the charge voltage to within the required tolerance (about ±1%). This required costly time and labor during manufacturing. Such circuits also typically made no provision for limiting the maximum amount of current delivered to the battery, which forced the circuit's power supply to be more robust than desired, leading to extra cost, or forced the circuits to endure overloading when highly-discharged batteries were first attached to the charger.

The circuits based around single-chip charger I.C.'s, such as the Unitrode UC3906, required many support components around the I.C., such as resistive voltage dividers and series-pass transistors, and bore the additional cost and single-sourcing problems of the charger I.C.'s themselves.

SUMMARY OF THE INVENTION

Accordingly, it is the principal object of the present invention to provide a voltage-regulator-based battery charger circuit that provides a current-limited and high precision, constant-amplitude D.C. voltage in a manner that is free from the labor and time intensive manual adjustment required by the prior art voltage-regulator-based battery charger circuits while being constructed of low-cost circuit elements. The battery charger of the invention in accord therewith includes a low-cost voltage regulator providing a nominal output voltage with comparatively-low precision. A voltage-control negative feedback loop, that includes a low-cost circuit element providing a reference of comparatively-high precision, a voltage sensing and setting resistor divider and an op amp, is coupled to the voltage regulator for locking the output voltage of the voltage regulator to the nominal output voltage with a precision that corresponds to the comparatively-high precision of the precision reference. A current-limiting negative feedback loop, that includes a low-cost voltage regulator current sensing and setting resistor and a comparator, cooperates with the voltage-control negative feedback loop for limiting to a maximum current the current supplied by the voltage regulator and for overriding the voltage-control negative feedback loop whenever the current drawn from the voltage regulator exceeds the maximum current. Nominal voltages are selected simply by choosing different fixed values of the resistors of the voltage sensing and setting resistor divider of the voltage-control negative feedback loop, and maximum current limits are selected simply by choosing different fixed values for the voltage regulator current sensing resistor of the current-limiting negative feedback loop. For any given set of values, the voltage-control and current-limiting feedback loops "automatically" maintain the maximum-current and constant-voltage set points, in a manner free from the time and labor consumptive manual adjustment required of the heretofore known voltage-regulator-based battery charger circuits.

BRIEF DESCRIPTION OF THE DRAWING

These and other objects, features and advantages of the instant invention will become apparent as the invention becomes better understood by referring to the following solely exemplary detailed description of the preferred embodiment thereof, and to the drawings, wherein:

The sole FIGURE of the drawings illustrates a schematic diagram of the novel manual-adjustment-free amplitude-controlled and current-limited D.C. voltage supply in accord with the present invention.

DETAILED DESCRIPTION OF THE PREFERRED EMBODIMENT

Referring now to the sole figure of the drawings, generally designated at 10 is a schematic diagram of the novel circuit of the invention. The circuit 10 includes an adjustable regulator 12 that has three pins; the first is marked "ADJ" for "adjustment", the second is marked "VOUT" for the "output voltage" thereof and the third of which is marked "VIN" for the "input voltage" thereto. Preferably, the adjustable voltage regulator 12 is the LM 317 adjustable regulator that has the property that the output voltage at the output pin thereof bears a specific relation of being one and one-fourth (1.25) volts above the adjustment voltage applied to the adjustment pin thereof. The adjustable regulator 12 is connected to a source of raw, unregulated power marked "VCC". The output voltage that appears on the output pin thereof, that is set by the adjustment voltage applied to the adjustment pin thereof, is, specifically for the LM 317, one and one-fourth (1.25) volts thereabove.

The LM 317 is preferred, because it is a low-cost component of reasonable quality, its precision being about two percent (2%). The voltage that appears on the output pin of the adjustable voltage regulator 12 is one and one-fourth (1.25) volts above the voltage that is supplied to the adjustment pin thereof, to within about the two percent (2%) precision. A voltage-control negative feedback loop that includes a low-cost precision reference to be described is provided to set the output voltage of the adjustable voltage regulator 12 to a nominal voltage and to stabilize the output voltage at the nominal voltage with a precision that corresponds to the precision of the low-cost precision reference.

A voltage divider schematically illustrated by dashed box 14, that includes the series resistors marked "R3" and "R4", is connected on the one hand to the output pin of the adjustable voltage regulator 12 through a series current sensing and setting resistor marked "R1" and on the other hand is connected to the battery to be charged generally designated 16 via a series fusible link marked "F1" and a diode marked "CR2". A diode marked "CR3" is connected in shunt between the fusible link "F1" and the diode "CR2". The diode "CR2" protects the linear regulator's output from loading the battery 16 during circuit power-down in order to prevent deep-discharging of the battery. The fuse "F1" and the diode "CR3" protect the circuit against accidental battery reverse-installation; in such a case, the diode "CR3" would conduct, and the fuse "F1" would open-circuit. The value selected for the current sensing and setting resistor "R1" determines the maximum-current setpoint as well as provides a voltage whose magnitude is representative of the magnitude of the current being drawn out of the adjustable voltage regulator 12 by the battery 16 by means of a current-limiting negative feedback loop to be described. The voltage sensing and setting resistors, "R3" and "R4", are connected directly across the battery 16, separated therefrom only by the fusible link "F1". In this way, all voltage drops associated with the current sensing performed by the current sensing and setting resistor "R1" and the forward junction of the diode "CR2" are included within the current-limiting negative feedback loop, and are thereby compensated out.

A comparator marked "U2A" having an output pin marked "1" and inverting and non-inverting input pins respectively marked "2" and "3" and an op amp marked "U2B" having an output pin marked "7" and inverting and non-inverting input pins respectively marked "6" and "5" are connected together across the current sensing and setting resistor "R1" with the inverting input of the comparator "U2A" connected to the output of the op amp "U2B", with the output of the comparator connected to the non-inverting input of the op amp, and with the non-inverting input of the comparator connected to the output of the current sensing and setting resistor marked "R1" and the input of the voltage divider 14 via the diode "CR2". A capacitor marked "C3" is connected in shunt to ground. The capacitor "C3" is provided for filtering the DC voltage. A precision reference marked "CR1" is connected to both the non-inverting input of the op amp "U2B" and to "VCC" via a resistor marked "R2". The precision reference "CR1" is preferably a precision (1%) one and two hundred thirty five thousandths (1.235) V reference.

The constant-voltage negative feedback loop includes the elements "R3" and "R4" of the voltage sensing and setting voltage divider 14, the precision reference "CR1" and the op-amp "U2B", and it operates as follows. The value of the resistance of the resistor "R4" of the voltage divider 14 is selected to match the voltage of the precision reference for a given nominal output voltage. For the nominal voltage shown of thirteen and eight tenths (13.8) volts, and for a precision reference voltage of one and two hundred thirty five thousandths (1.235) volts, the value of the resistance of the resistor "R4" that produces the same output voltage as that of the precision reference for the nominal voltage of thirteen and eight-tenths (13.8) volts is the one hundred fifteen thousand (115,000) ohm resistance illustrated. The op amp "U2B", that has the value of the voltage sensed across "R4" and the value of the voltage provided by the precision reference "CR1" across its inputs, drives its output to null and thereby provides an adjustment voltage on its output pin that adjusts the adjustable voltage regulator to maintain the nominal output voltage constant with a precision that corresponds to the precision of the precision reference. The resistors of the voltage divider 14 are preferably precision one-tenth percent (1/10%)resistors.

The current-limiting negative feedback loop includes among its elements the current sensing and setting resistor "R1" and the comparator "U2A" and the op amp "U2B", and it operates as follows. The comparator compares the voltage on the adjustment pin of the adjustable voltage regulator 12 with the voltage across the current sensing and setting resistor "R1", and it remains in its "high", open-collector state so long as the voltage at the adjustment pin and the voltage across the current sensing and setting resistor "R1" remain unequal. As more current is drawn by the battery 16, more voltage is dropped across the current sensing and setting resistor "R1". The voltage drop across the current sensing and setting resistor "R1" provides a measure of the current being drawn by the battery 16, as well as sets the maximum-current set point in dependence on the value of the resistance of the resistor "R1". For the preferred embodiment of the adjustable voltage regulator 12, the output voltage is one and one-fourth (1.25) volts above the voltage applied at the adjustable pin thereof. The voltage drop across the current sensing and setting resistor "R1" will equal the voltage at the adjustment pin of the adjustable voltage regulator whenever the current that flows therethrough is six hundred twenty five (625) milliamps, which corresponds to the maximum set point current; at this point, the inputs to the comparator become equal.

Whenever the inputs to the comparator "U2A" become equal, the output thereof goes low, shunting out the precision reference "CR1". The voltage across the precision resistor "R4" of the voltage divider 14 is then greater than that of the now shunted precision reference "CR1", which drives the op amp "U2B" low, which tells the adjustable voltage regulator 12 to lower the output voltage. This continues until the current through the current sensing and setting resistor "R1" is limited to the desired maximum output current, which, for the values illustrated, is six hundred twenty five (625) milliamps. If the battery was completely short-circuited, the regulator's output voltage would be dragged to nearly one and two-tenths (1.2) volts above ground for the preferred embodiment, and the circuit 10 would still be able to limit the output current to the desired level. As the load begins to draw less current, as, for example, when the battery begins to charge, the voltage across the current sensing and setting resistor "R1" drops, the comparator "U2A" raises its output again and the voltage-sense circuitry of the voltage-control negative feedback loop once again takes over.

It will be appreciated that the values of the voltage setting and current setting resistors illustrated are for the nominal thirteen and eight-tenths (13.8) volt constant-amplitude output voltage and for the six hundred twenty five (625) milliamp maximum-current. Of course, other values will produce other nominal voltages and currents, and may be selected without departing from the instant invention. A switching regulator or other equivalent may be substituted for the adjustable voltage regulator 12 of the preferred embodiment, and precision references, other than the precision diode "CR1", may be employed without departing from the instant invention. It should be noted that the current-limiting negative feedback loop is independent of the voltage-control negative feedback loop, which allows different maximum charging currents to be set for different power supply applications that can tolerate different charging-up time intervals. It should also be noted that an advantage of the invention is that deeply discharged batteries get maximum output current in the constant-current mode, but, eventually, as the battery charges, it gets constant-amplitude voltage, with whatever "top-off" current that is required. Finally, it should be noted that the circuit illustrated was designed to charge one or two lead-acid batteries, and that other kinds of batteries and other applications are contemplated.

Many modifications of the presently disclosed invention will become apparent to those having benefitted from the instant disclosure without departing from the inventive concepts.

What is claimed is:

1. A constant-voltage and current limited charging circuit, comprising:

an adjustable voltage regulator having an input terminal, an output terminal and an adjustment terminal;

a current sensing and setting circuit having a first terminal coupled to the output terminal of said adjustable voltage regulator and having a second terminal;

a voltage sensing and output voltage setting circuit having a first terminal coupled to the second terminal of said current sensing and setting circuit and having a second terminal;

a reference voltage source having an output terminal;

an op amp having an inverting input terminal, a non-inverting input terminal and an output terminal, wherein the inverting input terminal is coupled to the second terminal of said voltage sensing and setting circuit, the non-inverting input terminal is coupled to the output terminal of said reference voltage source and the output terminal is coupled to the adjustment terminal of said adjustable voltage regulator, said op amp for setting a voltage at the output terminal of said adjustable voltage regulator at a nominal voltage level, and for maintaining the voltage at the output terminal of said adjustable voltage regulator at the nominal voltage with a precision corresponding to the precision of said reference voltage source; and a comparator having an inverting input terminal, a non-inverting input terminal and an output terminal, wherein the inverting input terminal is coupled to the adjustment terminal of said adjustable voltage regulator, the non-inverting input terminal is coupled to the second terminal of said current sensing and setting circuit and the output terminal is coupled to the non-inverting input terminal of said op amp, said comparator for sensing the current being drawn from said adjustable voltage regulator, for setting a nominal maximum-current and for preventing the current being drawn from said adjustable voltage regulator from exceeding the nominal maximum current.

2. The invention of claim 1, wherein said adjustable voltage regulator is an LM 317.

3. The invention of claim 1, wherein said adjustable voltage regulator is an adjustable switching voltage regulator.

4. The invention of claim 1, wherein said voltage sensing and output voltage setting circuit is a voltage sensing and output voltage setting resistor divider network coupled to the output terminal of said adjustable voltage regulator.

5. The invention of claim 4, wherein said reference voltage source is provided as a precision LM 385 diode.

6. The invention of claim 5, wherein the op amp is an LM 392.

7. The invention of claim 5, wherein when the nominal voltage level is present at the output terminal of said adjustable voltage regulator, the voltage drop across one resistor of the voltage sensing and output voltage setting resistor divider network is made to be equal to the voltage provided by said reference voltage source.

8. The invention of claim 1, wherein said current sensing and setting circuit includes a current sensing and setting resistor having a first terminal connected to the output terminal of said adjustable voltage regulator and a second terminal coupled to the first terminal of said voltage sensing and output voltage setting circuit.

9. The invention of claim 8, wherein the voltage at the output terminal of said adjustable voltage regulator has a predetermined relation to a voltage provided to the adjustment terminal of said adjustable voltage regulator, and wherein the value of the current sensing and setting resistor is set in relation to the predetermined voltage relation to set the maximum current.

10. The invention of claim 9, wherein said comparator is an LM 392 comparator.

11. A constant-voltage and current limited charging circuit, comprising:

an adjustable voltage regulator having an output pin and an adjustment pin;

a current sensing and setting resistor having a first terminal coupled to the output terminal of said adjustable voltage regulator and having a second terminal;

a voltage divider circuit having a first terminal and a second terminal wherein the first terminal is coupled to the second terminal of said current sensing and setting resistor;

a reference voltage circuit for providing at an output terminal a reference voltage having a relatively high precision;

an op amp having an inverting input terminal, a non-inverting input terminal and an output terminal wherein the output terminal of said op amp is coupled to the adjustment pin of said adjustable voltage regulator, the non-inverting input terminal of said op amp is coupled to the output terminal of said reference voltage circuit and the inverting input terminal of said op amp is coupled to the second terminal of said voltage divider circuit; and a comparator having an inverting input terminal, a non-inverting input terminal and an output terminal, wherein the output terminal is connected to the non-inverting input terminal of said op amp, the inverting input terminal is connected to the adjustment pin of said adjustable voltage regulator and the non-inverting input terminal is coupled to the second terminal of said current sensing and setting resistor.

12. The invention of claim 11, wherein said adjustable voltage regulator is provided as an LM 317 adjustable voltage regulator.

13. The invention of claim 11, wherein:

said reference voltage circuit is provided as an LM 385 diode; and said voltage divider circuit includes:

a first resistor having a first terminal coupled to the second terminal of said current sensing and setting resistor and a second terminal; and a second resistor having a first terminal coupled to the second terminal of said first resistor and to the inverting input terminal of said op amp and having a second terminal coupled to ground wherein the resistance value of said second resistor of the voltage divider is selected such that for a given nominal output voltage a voltage drop across said second resistor equals the voltage drop across said reference voltage circuit.

14. The invention of claim 11, wherein said op amp is a LM 392 op amp.

15. The invention of claim 11, wherein said comparator is a LM 392 comparator.

16. A charging circuit comprising:

an adjustable voltage regulator having an input pin, an output pin and an adjustment pin;

a current sensing and setting resistor having a first terminal coupled to the output pin of said voltage regulator and having a second terminal;

an op amp having an inverting input terminal, a non-inverting input terminal and an output terminal, wherein the output terminal is coupled to the adjustment pin of said adjustable voltage regulator;

a comparator circuit having an inverting input terminal coupled to the adjustment pin of said adjustable voltage regulator, a non-inverting input terminal coupled to the second terminal of said current sensing and setting resistor and an output terminal coupled to the non-inverting input terminal of said op amp;

a first resistor having a first terminal and a second terminal, wherein the first terminal of said first resistor is coupled to the second terminal of said current sensing and setting resistor;

a second resistor having a first terminal coupled to the second terminal of said first resistor at a first node and to the inverting input terminal of said op amp and having a second terminal coupled to a first reference potential ground; and a reference voltage source having an output terminal coupled to the non-inverting input terminal of said op amp wherein said current sensing and setting resistor, said op amp and said comparator form a current limiting negative feedback circuit coupled to said adjustable voltage regulator and said first resistor, said second resistor, said reference voltage source and said op amp form a constant voltage negative feedback loop coupled to said adjustable voltage regulator.

17. The invention of claim 16, wherein the first reference potential corresponds to ground.

18. The invention of claim 17, wherein said second resistor is provided having a resistance value selected such that when a predetermined output voltage is provided at the output terminal of said adjustable voltage regulator a voltage drop across said second resistor equals a voltage drop across the reference voltage source.

19. The invention of claim 16, wherein said comparator is cooperative with the voltage control negative feedback loop and wherein said comparator sensing the current being drawn from said adjustable voltage regulator and sends a nominal maximum current voltage and when said comparator senses current being drawn from said adjustable voltage regulator is above the nominal maximum current said comparator overrides the voltage control negative feedback loop and maintains a current being drawn from said adjustable voltage regulator to the nominal maximum current.

20. The invention of claim 19 wherein said op-amp sends a voltage at the output terminal of said adjustable regulator at a nominal voltage level and maintains the voltage at the output terminal of said adjustable voltage regulator at the nominal voltage with a precision corresponding to the precision of said reference voltage source.

* * * * *